United States Patent [19]

Karube et al.

[11] Patent Number: 4,968,165

[45] Date of Patent: Nov. 6, 1990

[54] SHEET FEED CONTROL DEVICE AND METHOD IN A PRINTER WITH A TEAR BAR

[75] Inventors: Yoshiyuki Karube; Masaaki Hori, both of Nagoya, Japan

[73] Assignee: Brother Kogyo Kabushiki Kaisha, Japan

[21] Appl. No.: 234,626

[22] Filed: Aug. 22, 1988

[30] Foreign Application Priority Data

Aug. 24, 1987 [JP] Japan ..... 62-209743

[51] Int. Cl.[5] ..... B41J 11/64

[52] U.S. Cl. ..... 400/621; 400/593; 400/630; 400/709.2; 400/583

[58] Field of Search ..... 400/582, 583, 583.1, 400/583.2, 583.3, 583.4, 593, 611, 613.2, 616, 616.1, 616.2, 621, 621.2, 630, 632, 550, 630, 632, 709, 709.2

[56] References Cited

U.S. PATENT DOCUMENTS

| | | | |
|---|---|---|---|
| 3,276,562 | 10/1966 | Mathews | 400/582 |
| 3,960,258 | 6/1976 | Aebi | 400/582 |
| 4,266,880 | 5/1981 | Buchanan | 400/582 |
| 4,272,205 | 6/1981 | Bisczat et al. | 400/550 |
| 4,725,156 | 2/1988 | Proulx | 400/583.3 |

FOREIGN PATENT DOCUMENTS

| | | | |
|---|---|---|---|
| 0226327 | 11/1986 | European Pat. Off. . | |
| 91687 | 7/1980 | Japan . | |
| 207079 | 12/1982 | Japan | 400/583 |
| 162675 | 8/1985 | Japan | 400/621 |
| 175060 | 8/1986 | Japan . | |
| 44471 | 2/1987 | Japan . | |
| 74673 | 4/1987 | Japan . | |
| 1430047 | 3/1976 | United Kingdom . | |

*Primary Examiner*—David A. Wiecking
*Attorney, Agent, or Firm*—Oliff & Berridge

[57] ABSTRACT

In a printer of the kind which uses a continuous form print sheet having a plural pages each defined by perforated score lines formed in the widthwise direction of the sheet, a sheet feed control device is provided for controlling a sheet feed means for feeding the sheet. The control device includes a central processing unit which upon measuring a first line distance on the sheet, controls a sheet feeding means so that the perforated score line in the bottom of a printed page is brought in coincidence with a sheet cutting position. The print sheet can thus be separated at the line of perforations even if the first line distance is differently than that of the previous sheet.

19 Claims, 4 Drawing Sheets

SHEET FEED CONTROL DEVICE AND METHOD IN A PRINTER WITH A TEAR BAR

BACKGROUND OF THE INVENTION

The present invention relates to a sheet feed control device and a sheet feed control method in a printer.

A continuous form print sheet is used in printing data fed from a personal computer or the like, in which a perforated score line is formed in the widthwise direction of the sheet so that a printed page can be separated at the line of the perforations. When printing, the sheet is advanced by a feeding means to a position where printing is effected. Upon completion of one page of printing, a change-of-page signal is issued. In response thereto, the sheet is advanced to a position where an initial printing position of the next page confronts a printing station. In order to tear-off the printed page, the feeding means is driven to further advance the sheet by a predetermined distance by manipulation of a switch so that the perforated score line at the bottom of the printed page is brought to be in coincidence with a cutting means located downstream of the printing station.

However, such a sheet feeding is applicable only in the cases where a first line distance or an upper margin of the print sheet reserved between the leading edge of the sheet and the initial printing line is prefixed whatsoever the kind of the sheet may be, or the upper margin is determined by a total distance of a prefixed distance and a variable distance specified by a change-of-line signal posed ahead of the first line print position. Of the print sheets on which a format, such as border lines or ruled lines indicative of printing positions, etc., has previously been printed, the initial printing position is required to be accurately positioned in the printing position. In order to know if this positioning is precisely accomplished, a test printing is performed and, if unsatisfactory, an appropriate number of interline spacing instruction is inserted ahead of the printing data to further adjust the sheet position relative to the printing station. The perforated score line of the sheet can thus be brought to be in coincidence with the cutting means. However, the loading of the print sheet in such a way has proven to be intricate.

It is conceivable to load the continuous form print sheet in the printer in such a manner that upon coinciding the initial printing position with an index provided in the printer, the feeding means is driven to advance the sheet by a predetermined distance to thereby coincide the initial printing position with the printing position. While such a method is advantageous in that loading of the sheet is facilitated, a difficulty exists in that the perforated score line cannot coincide with the cutting means, since a distance between the leading edge of the incoming page and the initial printing line is not memorized in the printer.

SUMMARY OF THE INVENTION

In view of the foregoing, the present invention has been made to resolve the drawback where a perforated score line formed on a continuous form print sheet could not be brought in coincidence with a cutting means. Accordingly, it is an object of the invention to provide sheet feed control device and sheet feed control method in a printer in which a print sheet feeding means is controlled so that the perforated score line is accurately brought in coincidence with the cutting means even if a first line distance or an upper margin is set differently.

To achieve the above and other objects of the invention, there is provided a sheet feed control device for use in a printer of the kind including a feeding means for moving a print sheet in a sheet feeding direction along a sheet passageway, the print sheet having a leading edge, and the sheet passageway having first, second, third and fourth positions, the second position being downstream with respect to the sheet feeding direction of the first position and the third and fourth positions being upstream with respect to the sheet feeding direction of the first position, a platen disposed alongside of the first position for supporting the print sheet, a print head disposed alongside of the first position to confront the platen and bidirectionally movable along the platen for carrying out printing on the print sheet supported on the platen, and a cutting means disposed alongside of the second position for cutting the print sheet, the device comprising:

positioning means disposed alongside of the third position for positioning a preselected line on the print sheet to the third position;

detection means disposed alongside of the fourth position for detecting a presence of the print sheet and producing a sheet presence signal;

measuring means responsive to the sheet presence signal for measuring a distance L4 between the fourth position and a position of the leading edge of the print sheet placed in a position where the preselected line is positioned to the third position and outputting a distance signal; and control means for controlling the feeding means in accordance with distances L1 between the first position and the third position, L2 between the first position and the fourth position, and L3 between the first position and the second position and the distance L4, the control means comprising a first control means for controlling the feeding means to move the print sheet to a position where the preselected print line is in coincidence with the first position and a second control means for controlling the feeding means to move the print sheet to a position where the leading edge of the print sheet projects over the second position by a predetermined length.

According to another aspect of the invention, there is provided, in a printer of the kind including feeding means for moving a print sheet along a sheet passageway, the print sheet having a leading edge and being in a continuous form connecting a plural number of segmental sheets in succession at a boundary line, each segmental sheet having a predetermined length, and wherein printing is carried out from a preselected line in each of the segmental sheets, and the sheet passageway having first, second, third and fourth positions, the second position being downstream of the first position and the third and fourth positions being upstream of the first position, a printing means disposed alongside of the first position for carrying out printing on the print sheet, cutting means disposed alongside of the second position for cutting the print sheet in every segmental sheet, and control means for controlling the feeding means, a feed control method of the print sheet comprising the steps of:

(a) manually moving the preselected line of a first segmental sheet of the print sheet to the third position;

(b) measuring a distance L4 between the fourth position and the leading edge;
(c) moving the print sheet to the first position; and
(d) moving the print sheet in accordance with the distance L4 being measured in the step (b) until the boundary line is in coincidence with the second position.

DETAILED DESCRIPTION OF THE PREFERRED EMBODIMENTS

Figure 1:
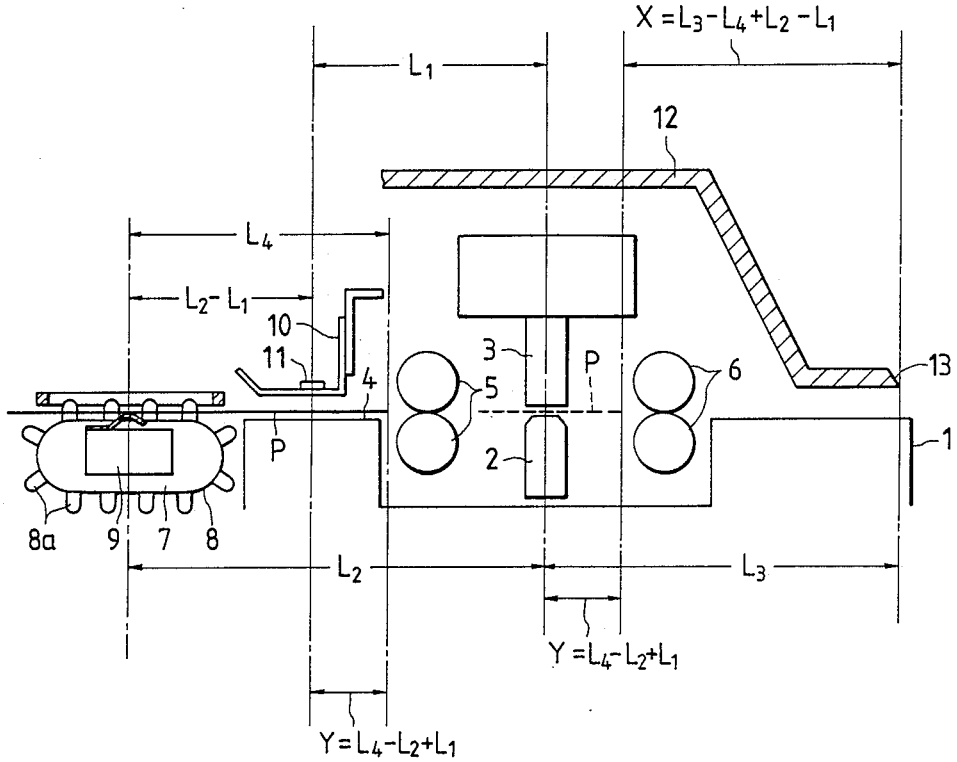
FIG. 1 is a cross-sectional view showing one embodiment of a printer embodying the present invention.

Preferred embodiments of the present invention will now be described with reference to the accompanying drawings. As shown in FIG. 1, a platen 2 is housed in a printer defined by a frame 1 and a lid member 12. The platen 2 has a longitudinal axis extending, in the figure, in the direction perpendicular to the sheet of drawing. A print head 3 is disposed above the platen 2 to be bidirectionally movable along the platen 2. A sheet passageway 4 is formed in the direction perpendicular to the axial direction of the platen 2 and extends between the platen 2 and the print head 3. A continuous form print sheet P travels in the passageway 4 normally rightwardly with its printing face up. Streams of the platen 2, guide roller pairs 5, 6 are rotatably disposed on respective sides of platen 2. The print sheet P passes through a nip between the rollers of each pair and the travel of the sheet is thereby guided. Upstream of the guide roller pair 5, a pair of pin tractors 7 are disposed slightly below the side portions of the sheet passageway 4. Around each pin tractor 7, an endless belt 8 is rotatably stretched. On the outer periphery of the belt 8, a plurality of pins 8*a* are mounted at equi-intervals. The belt 8 is rotated in clockwise or counter-clockwise direction by a pulse motor 21 to thus move the sheet P rightwardly or leftwardly, in which the pins 8*a* sequentially engage perforations (not shown) formed along both side margin portions of the sheet P. The guide roller pairs 5, 6 are also rotated by the pulse motor 21 in synchronization with the rotations of the pin tractors 7. In the vicinity of either one of the pin tractors 7, a sheet detection switch 9 is disposed for detecting presence of the sheet P by engagement of the switch 9 with the print sheet P. When the presence of the sheet P is detected by the switch 9, a sheet detection signal is produced therefrom.

Between the pin tractors 7 and the guide roller pair 5 and above the passageway 4, is disposed an index member 10 which is made of a transparent synthetic resin. The index member is L-shaped in cross-section and extends in the widthwise direction of the print sheet P. In the index member 10, an index 11 is formed for indicating an initial print position on the print paper P. The index 11 is in the form of a measure or a scale mark printed on the index member 10.

The lid member 12 is attached to the frame 1 for covering the upper portion of the printer. A cutting blade 13 is formed in the lid member 12, which is positioned immediately above the passageway 4 and in downstream of the guide roller pair 6. Each page of the continuous form print sheet P can be torn off at the perforated score line by pulling the sheet P along an inclined wall of the lid member 12.

Figure 2:
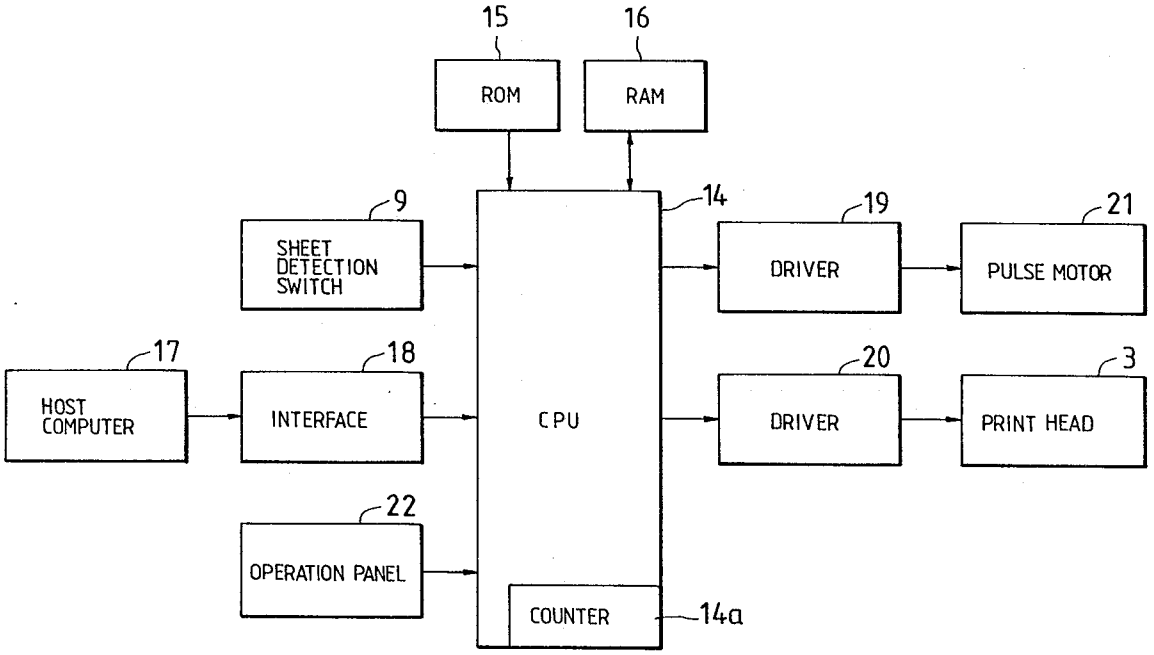
FIG. 2 is a block diagram showing a control device for controlling the printer of the invention.

A control device for controlling the printer according to this embodiment is arranged as shown in FIG. 2. The control device includes a central processing unit (CPU) 14 incorporating therein a counter 14*a*. A read-only memory (ROM) 15 and a random access memory (ROM) 16 are connected to the CPU 14. Printer control programs as shown in flowcharts of FIGS. 3 and 4 and feed distance data set forth below have previously been programmed in the ROM 15. The feed distance data are as follows.

L1: a feed distance data indicative of a distance between an indexed position specified by the index 11 and the print position where the sheet P is printed by the print head 3;

L2: a feed distance data indicative of a distance between a sheet detection position by the sheet detection switch 9 and the print position; and L3: a feed distance data indicative of a distance between the blade position and the print position.

In the RAM 16, a feed distance data L4 is programmed which is indicative of a distance between the position of the detector 9 and the top of the print sheet P when placed in such a manner that the initial print position or the print start position is aligned with the index 11.

The sheet detection signal produced from the sheet detection switch 9 is applied to the CPU 14. A sheet feed signal, such as a sheet insertion signal, is applied to the CPU 14 from either the host computer 17 via an interface 18 or the operation panel 22 mounted on the printer by manipulations of a particular key. Print data are further applied thereto from a host computer 17 via the interface 18. In response to those input signals and in accordance with the control programs, the CPU 14 outputs drive signals to the pulse motor 21 and the print head 3 through drivers 19, 20, respectively.

Figure 3:
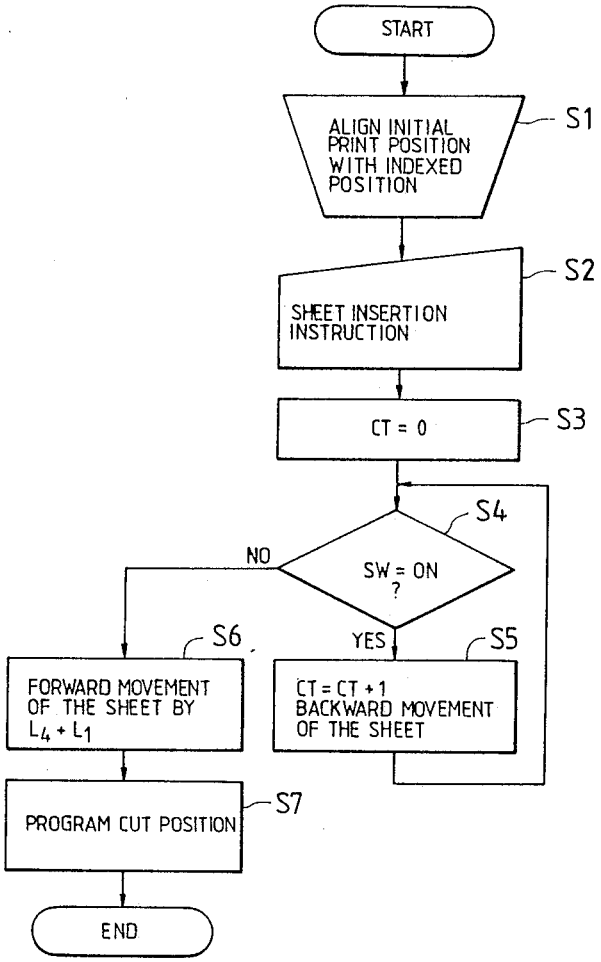
FIGS. 3 and 4 are flowcharts for description of operational sequences executed by a central processing unit incorporated in the control device.

Next, referring to FIG. 3, the operation of the above identified printer will be described. In step 1, the initial print position of the first page of the print sheet P is aligned with the index 11 in the indexing member 10. A format has previously been printed on each page of the print sheet P for specifying the printing positions. The initial print position is also specified by such a format. When the sheet insertion signal is inputted from either the host computer 17 via the interface 18 or the operation panel 22 by manipulations of a key, the CPU 14 resets the counter 14*a* to zero (steps 2 and 3). Next, the CPU 14 judges whether or not there is an input of the sheet detection signal from the sheet detection switch 9. The counter 14*a* keeps on performing incremental-counting until the results of the judgement indicate "no". The pulse motor 21 is rotated in reverse by a predetermined number of pulses in accordance with each of the incremental counts of the counter 14*a*, so that the leading edge of the print sheet P is moved leftwardly toward the sheet detection switch 9 by means of the pin tractors 7. The CPU 14 computes the feed distance L4 based on the count numbers in the counter (steps 4 and 5).

When the sheet detection signal has not been produced from the sheet detection switch 9, i.e. when the leading edge of the print sheet P has just passed over the leading edge of the print sheet P has just passed over the switch 9, the CPU 14 causes the pulse motor 21 to forwardly rotate so that the print sheet P is moved rightwardly toward the print head 3 for a distance defined by a sum of L4 and L1 (step 6). Then, the initial print position on the print sheet P is brought to be in coincidence with the print head 3. On the basis of the feed distance data L1, L2 and L3 and the feed distance data L4 which has previously been computed, the CPU 14 computes a feed data X indicative of a distance between the leading edge of the sheet P placed in the state that the initial print position is in coincidence with the print head 3 and the blade position in accordance with the following equation. The resultant data X is stored in the RAM 16 (step 7).

$$\begin{aligned} X &= L3 - \{L4 - (L2 - L1)\} \\ &= L3 - L4 + L2 - L1 \\ &= L3 - Y \end{aligned}$$

where Y is an initial line distance or an upper margin which can be expressed by $Y=L4-L2+L1$.

Thereafter, the CPU 14 controls the print head 3 and the pulse motor 21 in accordance with the print data transmitted from the host computer 17. When one page printing is terminated, a change-of-page signal is transmitted from the host computer 17. In response thereto, the CPU 14 causes the pulse motor 21 to forwardly rotate by a particular number of rotations in accordance with a total number of print lines which the print head has passed over from the begining of the page and the sheet length of one page. More specifically, one page of the print sheet contains a predetermined number of printable lines and the line number N which the print head is confronting is being counted by the CPU 14. Therefore, from the one page length L and the line number N which the print head is confronting, a distance from the last print line of the first page to the initial print line of the second page can be calculated by $L-P\times N$, where P is a predetermined interline space. The one page length L and the interline space P have previously been stored in the ROM 15. Thus, the initial print position of the second page can be placed immediately below the print head 3. The pulse motor 21 does not rotate until the print data for the next page is received.

Figure 4:
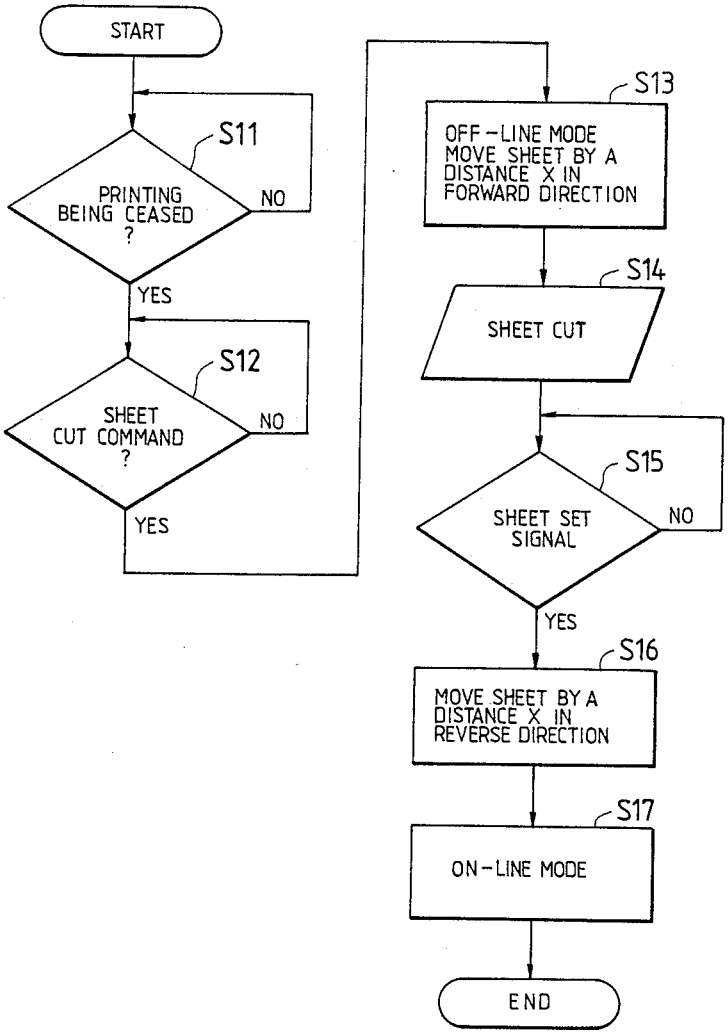

As shown in FIG. 4, when the next printing data is received and the printing operation is ceased (step 11), a sheet cut command may be inputted by a manipulation of a key in the operation panel 22 or by the host computer 17 (step 12). Then, the CPU 14 switches the printer from on-line mode to off-line mode and supplies the host computer 14 with a busy signal disabling data transmission from the host computer 17 to the printer. At the same time, the pulse motor 21 is forwardly rotated in accordance with the feed data X which has been stored in the RAM 16. The print sheet P is then advanced rightwardly and the perforated score line at the bottom of the first page is aligned with the cutting blade 13 (step 14).

According to this embodiment, the perforated score line can thus be automatically and accurately aligned with the cutting blade 13 regardless of a first line distance or an upper margin Y, and the printed page can be torn off (step 14).

When a sheet set signal is inputted (step 15) by manipulations of a certain key in the operation panel 22, the CPU 14 reads the feed distance data X out of the RAM 16 and causes the pulse motor 21 to rotate in reverse by the feed distance data X (step 16). In accordance with the reverse rotations of the motor, the sheet P is moved leftwardly and an initial print position of the second page is placed immediately below the print head 3. When this leftward movement of the sheet P is terminated, the printer is switched from the off-line mode to the on-line mode (step 17) and the supply of the busy signal is stopped. Thus, the printer is placed in a state capable of printing.

The above-described embodiment can be modified so that after one page printing is terminated, the sheet feed operation is not carried out. That is, the sheet P is held in a state that the last printing line confronts the print head 3. The pulse motor is forwardly rotated by a predetermined number of rotations to advance the sheet to a position where the perforated score line is aligned with the cutting blade 13. In this modification, a feed distance Z of the sheet is represented by:

$$Z=L-(A+Y)+L3$$

where L is a one page length of the sheet P and A is an interline spacing when printing the data. After the sheet P is torn off, the sheet is leftwardly moved by the distance X.

When the sheet cut command is inputted, judgement may be made as to whether or not a change-of-page signal has been inputted previously. When affirmative, the print sheet P is moved by the distance X in the forward direction, whereas when negative, the print sheet P is moved by the distance Z in the same direction.

Figure 5:
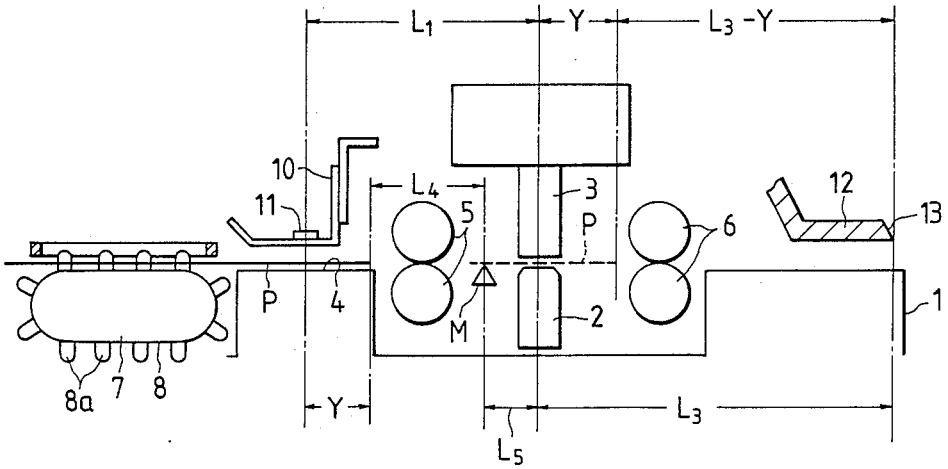
FIG. 5 is a cross-sectional view showing another embodiment of the printer embodying the invention.

A second embodiment of the invention will next be described with reference to FIG. 5. The second embodiment differs from the first embodiment in that the sheet detection switch 9 is disposed in a position indicated by character M between the print head 3 and the upstream guide roller pair 5. In this embodiment, after the initial print position on the first page of the continuous form print sheet P is aligned with the index 11, the sheet P is moved rightwardly by a distance L1 by means of the pin tractors 7. To this effect, the pulse motor 21 is forwardly rotated. The initial print position is thus placed in a position immediately below the print head 3. A feed distance L4 is computed based on the occurrence of a sheet detection signal. The CPU 14 computes a first line distance Y between the leading edge of the first page and the initial print line according to the equation of $Y=L1-L4-L5$ where L5 is a distance between the position of the sheet detection switch 9 and the print position. The distance L5 has been previously programmed in the ROM 15. The CPU 14 further computes a feed distance W between the leading edge of the sheet placed in the state that the initial print position is aligned with the print head 3 and the position of the cutting blade 13. The feed distance W is represented by the equation of $W=L3-Y$. The resultant value W is programmed in the RAM 16.

According to the second embodiment, like the first embodiment, regardless of the first line distance Y, the perforated score line in the sheet P can be automatically and accurately aligned with the cutting blade 13 after the printing of one page is terminated, and the printed page can be torn off from the perforated score line. The initial print position on the second page of the continuous form print sheet can be positioned immediately below the print head 3. Furthermore, according to the second embodiment, it is not necessary that the printing sheet be bidirectionally moved, thus the control of the pulse motor is simplified.

As described, the present invention provides a sheet feed control device in which a perforated score line on the sheet can be automatically and accurately aligned with the cutting blade regardless of the first line distance, and the printed page can be torn off from the continuous sheet.

What is claimed is:

1. A sheet feed control device in combination with a printer of the kind including feeding means for moving a print sheet in a sheet feeding direction along a sheet passageway, said printer sheet having a leading edge, and said sheet passageway having first, second, third and fourth positions, said second position being downstream with respect to said sheet feeding direction of said first position and said third and fourth positions being upstream with respect to said sheet feeding direction of said first position, a platen disposed alongside of said first position for supporting said print sheet, a print head disposed alongside of said first position to confront said platen and bidirectionally movable along said platen for carrying out printing on sasid print sheet supported on said platen, and a tear bar disposed alongside of said second position, said device comprising:

indexing means, disposed alongside of said third position, for indicating to an operator the initial print position of a preselected line;

detection means disposed alongside of said fourth position for detecting a presence of said print sheet and producing a sheet presence signal;

measuring means responsive to said sheet presence signal for measuring a distance L4 between said fourth position and a position of said leading edge when said print sheet is placed in a position where said preselected line is positioned to said third position and outputting a distance signal; and a control means for controlling said feeding means in accordance with distances L1 between said first position and said third position, L2 between said first position and said fourth position, and L3 between said first position and said second position and said distance L4, said control means comprising a first control means for controlling said feeding means to move said print sheet to a position where said preselected line is in coincidence with said first position and a second control means for controlling said feeding means to move said print sheet to a position where said leading edge of said print sheet projects over said second position by a predetermined length.

2. The device as claimed in claim 1, wherein said control means further comprises storage means for storing data on said distances L1, L2, L3 and L4.

3. The device as claimed in claim 1, wherein said print sheet is in a continuous form connecting a plurality of segmental sheets in succession at respective boundary lines, each of said segmental sheets having said predetermined length.

4. The device as claimed in claim 3, wherein said fourth position is downstream of said third position with respect to said feeding direction.

5. The device as claimed in claim 3, wherein said fourth position is upstream of said third position with respect to said feeding direction.

6. The device as claimed in claim 3, wherein said measuring means outputs said distance signal on the basis of the outputting of said presence signal.

7. A sheet feed control device in combination with a printer of the kind including feeding means for moving a print sheet in a sheet feeding direction along a sheet passageway, said print sheet being in a continuous form connecting a plurality of segmental sheets in succession at respective boundary lines and having a leading edge, and said sheet passageway having first, second, third and fourth positions, said second position being downstream with respect to said sheet feeding direction of said first position and said third and fourth positions being upstream with respect to said sheet feeding direction of said first position, printing means disposed alongside of said first position for carrying out printing on said print sheet, and a tear bar disposed alongside of said second position, said device comprising:

indexing means, disposed alongside of said third position, for indicating to an operator the initial print position of a preselected print line;

detection means disposed alongside of said fourth position for detecting the leading edge of the print sheet;

measuring means for measuring a print sheet moving distance L4 which a sheet is moved by said feeding means from a position where the preselected print line is in coincidence with the third position to a position where the leading edge of the print sheet is detected by said detection means; and control means for controlling said feeding means in accordance with distance L2 between said first position and said fourth position and L3 between said first position and said second position, said control means controlling said feeding means to move said print sheet to a position where its respective boundary line is in coincidence with said second position.

8. The device as claimed in claim 7, wherein said control means controls said feeding means in accordance with distances L1 between said first position and said third position, L2 between said first position and said fourth position, and L3 between said first position and said second position and said distance signal, said control means controlling said feeding means to move said print sheet to a position wherre said preselected print position is in coincidence with said first line.

9. The device as claimed in claim 8, wherein said control means controls said feeding means to feed the print sheet from the position where the leading edge is detected by said detection means to the first position by a distance L4+L1.

10. The device as claimed in claim 7, wherein said measuring means comprises counting means for counting a number corresponding to a period of time during which said leading edge of said print sheet is moved from a position where said preselected print line is positioned in said third position until it is no longer detected by said detection means.

11. The device as claimed in claim 7, wherein said control means controls said feeding means to feed the print sheet from a position where the preselected print line is in the first position to a position where the boundary line is in coincidence with the second position by a distance $X=L3-L4+L2-L1$.

12. In a printer of the kind including feeding means for moving a print sheet along a sheet passageway, said print sheet having a leading edge and being in a continuous form connecting a plurality of segmental sheets in succession at respective boundary lines, each segmental sheet having a predetermined length, and wherein printing is carried out from a preselected line in each of said segmental sheets, and said sheet passageway having first, second, third and fourth positions, said second position being downstream of said first position and said third and fourth positions being upstream of said first position, printing means disposed alongside of said first position for carrying out printing on said print sheet, a tear bar disposed alongside of said second position, an indexing member disposed alongside of said third position, and control means for controlling said feeding means, a feed control method of said print sheet comprising the steps of:

(a) manually aligning said preselected line of a first segmental sheet of its respective print sheet to said indexing member at said third position;
(b) measuring a distance L4 between said fourth position and said leading edge;
(c) moving said print sheet to said first position; and
(d) moving said print sheet in accordance with said distance L4 being measured in said step (b) until said boundary line is in coincidence with said second position.

13. The method as claimed in claim 12, wherein in said step (c), said print sheet is moved until said preselected line is brought to be in coincidence with said first position and is further moved in accordance with the printing operation by said printing means.

14. The method as claimed in claim 13, wherein said step (c) further comprises moving said print sheet from a position where a preceding segmental sheet is placed in said first position to a position where said preselected line of the subsequent segmental sheet is in coincidence with said first position.

15. The method as claimed in claim 14, wherein said third position is downstream of said fourth position with respect to said feeding direction, and wherein in said step (d), when said print sheet is in a position such that a printed segmental sheet is in said first position, said print sheet is moved by a distance Z represented by an equation $Z=L-(A+L4-L2+L1)+L3$, where L is said predetermined length, A is a distance to said printing operation, L1 is a distance between said first position and said third position, L2 is a distance between said first position and said fourth position, and L3 is a distance between said first position and said second position.

16. The method as claimed in claim 14, wherein said third position is upstream of said fourth position with respect to said feeding direction, and wherein in said step (d), when said print sheet is in a position such that said preselected print position is in said first position, said print sheet is moved by a distance W represented by an equation $W=L3-(L1-L4-L5)$, where L1 is a distance between said first position and said third position, L3 is a distance between said first position and said second position, and L5 is a distance between said first position and said fourth position.

17. A method as claimed in claim 14, wherein said third position is downstream of said fourth position with respect to said feeding direction, and wherein in said step (d), when said print sheet is in a position where said preselected line is in said first position, said print sheet is moved by a distance X represented by an equation $X=L3-L4+L2-L1$, where L3 is a distance between said first position and said second position, L2 is a distance between said first position and said fourth position and L1 is a distance between said first position and said third position.

18. The method as claimed in claim 17, wherein said control means include storage means for storing data on said distances L1, L2, L3 and L4, and computing means for computing said distance X in accordance with said equation and outputting data on said distance X to said feeding means to move, in said step (d), said print sheet by said distance X.

19. The method as claimed in claim 18, wherein a leading edge detecting means is disposed alongside of said fourth position for detecting said leading edge, and wherein in said step (b), from a position where said print sheet has been moved in step (a), said print sheet is backwardly moved until said leading edge is detected by said leading edge detecting means to thus measure said distance L4, and then said print sheet is forwardly moved by a sum of said distances L4 and L1.

* * * * *